United States Patent [19]

Ishihara

[11] Patent Number: 4,490,602

[45] Date of Patent: Dec. 25, 1984

[54] AIR FLOW ADJUSTING MECHANISM FOR HAND HELD HOT AIR HAIR DRYER

[76] Inventor: Naoki Ishihara, Flat 209, Viking Villa, 70 Tin Tau Temple Rd., Hong Kong, Hong Kong

[21] Appl. No.: 467,494

[22] Filed: Feb. 18, 1983

[51] Int. Cl.[3] ..... A45D 20/12; F01B 25/02; F24H 3/04; H05B 1/00

[52] U.S. Cl. ..... 219/370; 34/97; 219/366; 219/368; 415/127; 415/145

[58] Field of Search ..... 219/366, 370, 367, 368, 219/364, 369, 371, 380, 373; 34/96–98, 100, 101; 415/184, 144, 127, 145; 165/103

[56] References Cited

U.S. PATENT DOCUMENTS

| | | | |
|---|---|---|---|
| 1,832,899 | 11/1931 | Frederics | 219/371 |
| 1,935,120 | 11/1933 | Hagen | 415/144 |
| 2,013,572 | 9/1935 | McCord | 219/370 |
| 2,074,018 | 3/1937 | Gross | 219/371 |
| 2,795,372 | 6/1957 | Szydlowski | 415/144 |
| 2,834,534 | 5/1958 | Kadosch et al. | 415/145 |
| 3,279,385 | 10/1966 | Suzuki | 415/127 |
| 3,796,511 | 3/1974 | Hansen | 415/144 |
| 3,846,047 | 11/1974 | Wada et al. | 219/366 |
| 4,162,395 | 7/1979 | Kobayashi et al. | 219/370 |
| 4,214,149 | 7/1980 | Hoffmann | 219/364 |
| 4,297,564 | 10/1981 | Bartolac | 219/370 |

FOREIGN PATENT DOCUMENTS

| | | | |
|---|---|---|---|
| 7600647 | 1/1976 | Netherlands | 219/370 |
| 548005 | 9/1942 | United Kingdom | 415/144 |

*Primary Examiner*—Clifford C. Shaw
*Assistant Examiner*—Geoffrey S. Evans
*Attorney, Agent, or Firm*—Moonray Kojima

[57] ABSTRACT

In a hand held hot air hair dryer, wherein air is pulled in by a fan in a direction axially to the fan and then moved about the axis and through a heating mechanism to exit through a nozzle, air flow adjusting mechanism is provided to leak air flowing about the axis and thereby selectively adjusting the hot air flowing out the nozzle, without inducing any substantial changes of load to the motor driving the fan.

6 Claims, 12 Drawing Figures

AIR FLOW ADJUSTING MECHANISM FOR HAND HELD HOT AIR HAIR DRYER

BACKGROUND OF THE INVENTION

1. Field of the Invention

This invention relates to hand held hot air hair dryers, and more particularly to improvements therein whereby hot air flow rate is mechanically adjusted without any substantial change in the electrical load to the motor driving the fan therein.

2. Description of the Prior Art

A conventional hand held hot air hair dryer usually comprises an outer housing having an opening in the sides thereof for entrance of air, and a nozzle mouth for exit of hot air, an inner housing disposed in the outer housing and also having a mouth for the exit of blown air and side openings conforming to the side openings in the outer housing for entry of air, a fan disposed within the inner housing and driven by a motor, and heater means disposed toward the mouth of the outer housing for heating the blow air prior to exit from the nozzle mouth. A first electrical switch is used for varying the power supplied to the heater, and a second electrical switch is used for varying the speed of the motor to thereby vary the velocity of the air flow exiting the nozzle mouth.

A particularly difficult problem arises in that changing the air speed by changing the motor speed places substantial load variations on the motor and greatly reduces the efficiency and life of the hair dryer.

SUMMARY OF THE INVENTION

Accordingly, an object of the invention is to overcome the aforementioned and other deficiencies and disadvantages of the prior art.

Another object is to vary the hot air flow blown from a hair dryer without substantially varying the motor speed and load or the heat.

A further object is to enable variations of the motor speed and heat with use of a single electrical switch and to enable variations of air flow speed without use of any electrical switch.

The foregoing and other objects of the invention are attained in a hand held hot air hair dryer, comprising an outer housing having a hollow cylindrically shaped nozzle mouth portion, a handle portion and interconnecting the mouth and hand portions a substantially flat circular central portion, with the central portion having openings in the flat sides thereof; an inner housing disposed in the outer housing with a substantially cylindrical open portion to fit in the mouth portion and a flat circular portion to fit in the central portion and with open sides thereof to be exposed to the open sides of the central portion; a motor; a fan connected to and driven by a motor, and disposed within the inner housing, for moving air coming through the side openings of the central inner housing and outer housing, and circulating the air around the axis of the fan and through the nozzle mouth portion; heater means disposed within the nozzle portion of the outer housing and adjacent the mouth portion, for heating the air as it passes through and is blown out of the mouth; and electrical switching mechanism for supplying current to the motor and heater means in two positions of low and high heat and of low and high motor speed; wherein the dryer is improved by an adjustable air flow mechanism whereby air is leaked from an opening in the inner housing along the periphery thereof, in selective varying amounts thereby to selectively vary the hot air flow exiting from the mouth of the dryer.

The adjustable air flow mechanism comprises an opening in the circular periphery of the inner housing, a rotatable door which opens and closes the opening in the inner housing and a mechanical switch for moving the door to the different opening positions. Thus, when the door is closed and the mechanical switch is in one position, the air flow rateout of the mouth is at its maximum, and when the door is at its maximum open position, the air flow rate out of the mouth is at its minimum, with varying air flow rate positions therebetween being possible.

Advantageously, the fan takes air in axially and moves the air circularly generally about the axis. Thus, by opening the door some of the circulating air will be bled off before air is forced out of the mouth. By varying the opening in the periphery edge of the inner housing, the heated air flow rate exiting the mouth can be varied. In this manner, it was discovered, that air flow rate could be varied without any substantial effect on the motor speed or load. This is a surprising and unexpected result which greatly increased life and effeciency of dryers.

A feature of the invention is a mechanical device for varying the amount of air flow rate exhausted from the nozzle of a hand held hair dryer, without the necessity of electrically varying the speed of the motor used therein to drive the fan.

Another feature is the use of an opening in the inner housing of such dryer along the periphery thereof in the direction of travel of air driven about the axis of the fan.

A further feature is the use of selectively rotatable door in combination with the opening in the inner housing to selectively vary the degree of opening of the inner housing to the outside.

Another feature is the use of the door to divert the amount of air moving about the axis of the fan with the amount of diversion depending on the angle at which the door meets air being circulated about the axis of the fan.

A further feature is an electrical circuit comprising heater coils and motor in parallel with an A-C external source and in series with an electrical switch and diode combination, whereby in one position, the heater coils will be at full heat and full speed of the motor, and in another position, the heater coils will be at low heat and low speed of the motor; and whereby the amount of air flow rate at the mouth, is independent of the electrical switch positions.

Another feature is the use of a diode in one switch position to half wave block the power and thereby cause one half wave power to be applied to the motor and heater, and whereby without use of the diode, will apply full power to the heater and motor.

DETAILED DESCRIPTION OF PREFERRED EMBODIMENTS

Figure 1:
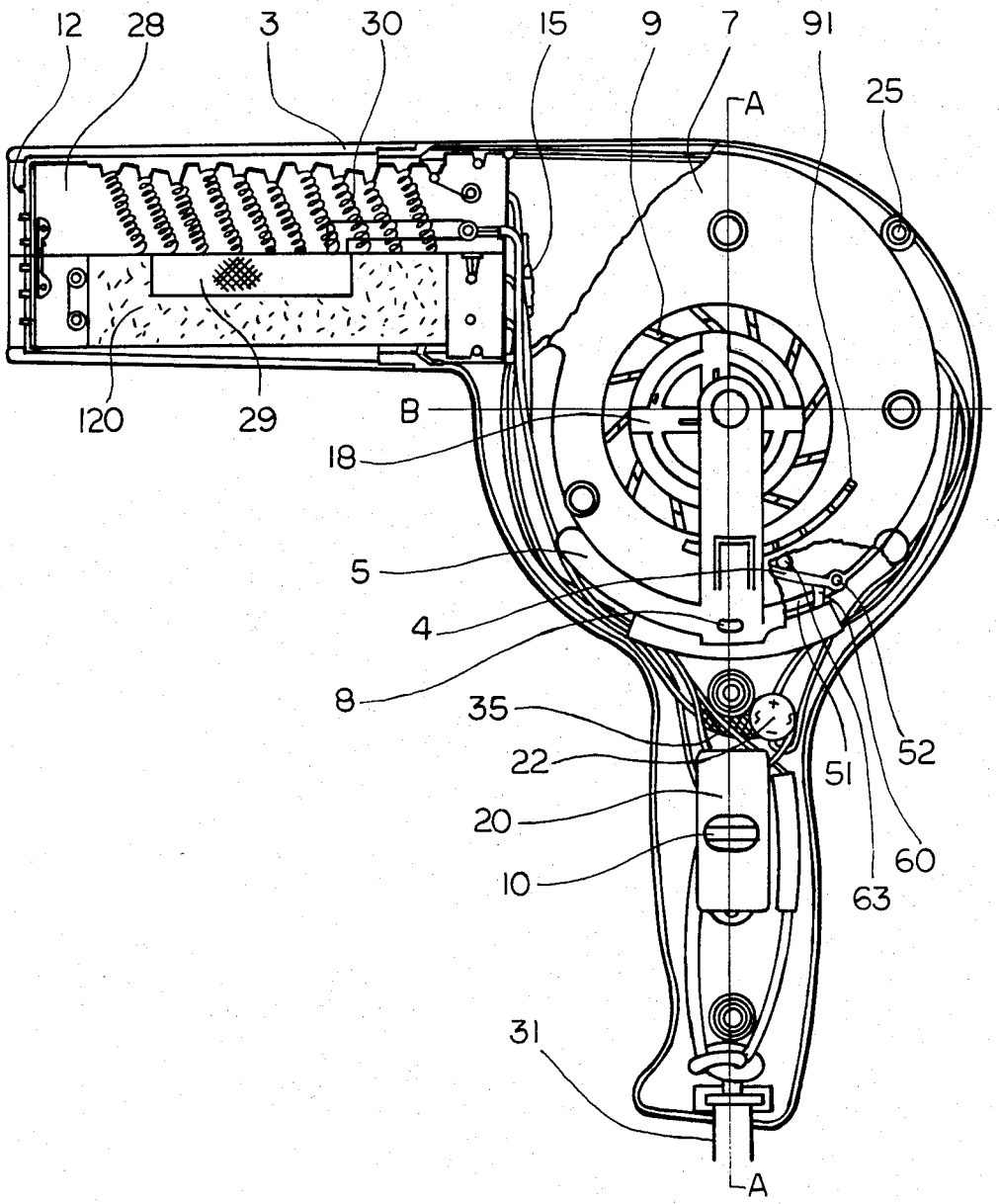
FIG. 1 depicts a cut out left side elevational view of a hot air hand held hair dryer, wherein an illustrative embodiment of the invention is employed.
Figure 2:
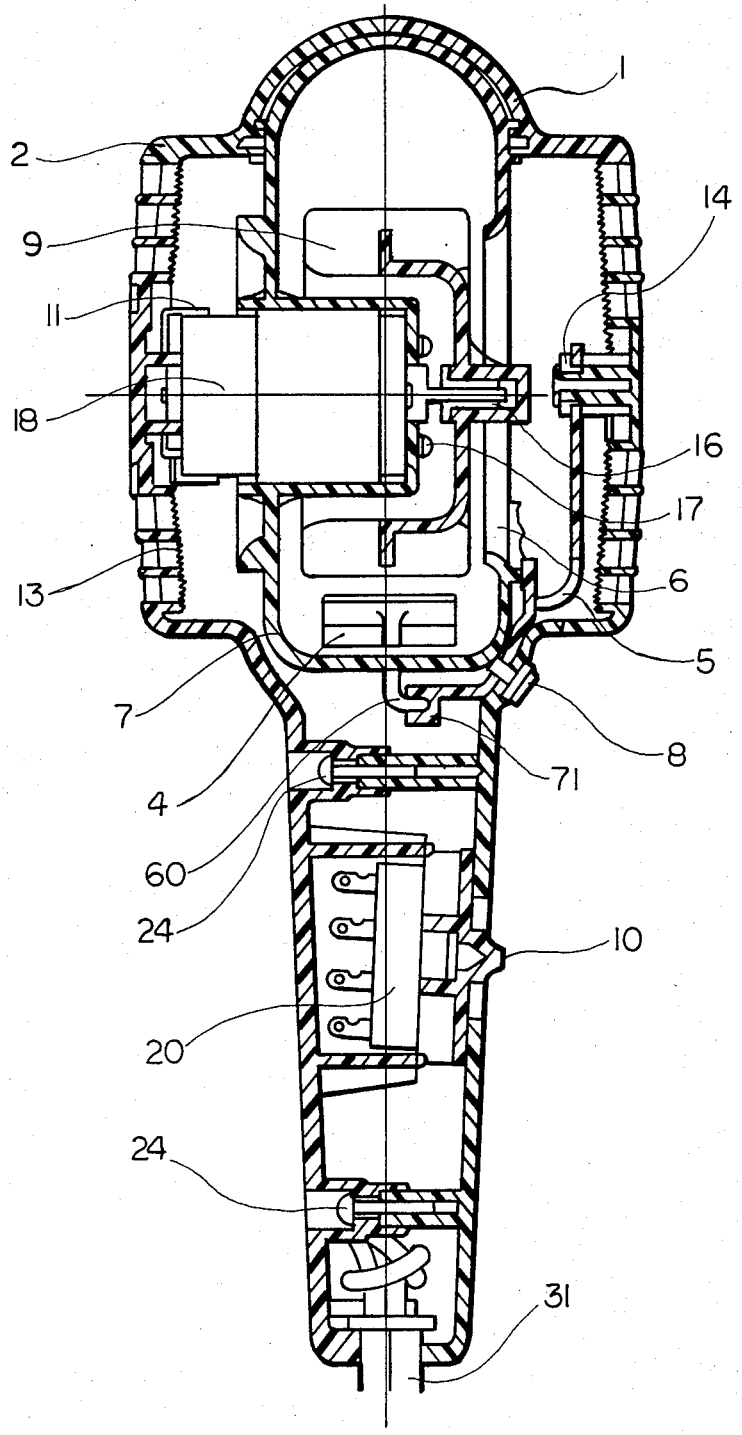
FIG. 2 depicts a cross sectional view taken along section line A—A in the embodiment of FIG. 1.

Turning now to FIGS. 1 and 2, there is depicted a hand held hot air hair dryer, comprising an outer housing 1,2 made of right portion 2 which is attached by screws such as screw 24, 25 to left portion 1; a motor 18 having a shaft connected to a paddle wheel type fan 9, a cylindrical nozzle 3 having a mouth therein for exhausting hot air; a plurality of heating coils 30 for heating air circulated by fan 9 through nozzle 3 and contacting heating coils 30 prior to exhausting out of the mouth of the nozzle. The heating coils 30 are mounted on a mounting card 29 and surrounded by a mica heat shield 120. A grill 12 covers the mouth of the nozzle 3. Located within the outer housing and conforming to the general shape thereof is an inner housing having a right portion 7 and a left portion 6; lead wires 35; full wave rectifier 22; diode 15; electrical switch 20; switch extender button 10; and lead to outside power source 31.

The outer housing has connected thereto at one part nozzle 3 within which heater coils 30 are disposed. The mica heat shield 20 is placed between the heater coils 30 and nozzle 3 for safety of operation and for convenience of the operator. The outer housing has a central portion wherein is disposed the inner housing, fan and motor. The outer housing also has a handle portion having therein disposed electrical switch 20, electrical lead 31 and bridge rectifier 22. The outer housing and inner housing have at both sides thereof openings to the outside, with the openings covered by a screen 13.

In the hair dryer so far described, when motor 18 is turned on, fan 9 will rotate in a counter clockwise direction, and draw air in a direction axially of the fan, from the outside through the openings in the sides of the central portion of the outer housing and the corresponding portions of the inner housing, and circulate the air generally about its axis and then through the nozzle and exit the mouth thereof. During the transversal through the nozzle, the air will contact the heater coils 30 which are turned on by electrical switch 20 connecting the outside current to the coils 30 and motor 18. Thus, the circulating air will become heated prior to being exhausted through the mouth of the nozzle. Accordingly, the exhausted air will be hot, with the temperature being dependent on the amount of power supplied to the heater coils 30. The electrical connections will be explained hereinafter with reference to FIG. 3.

Figure 5A:
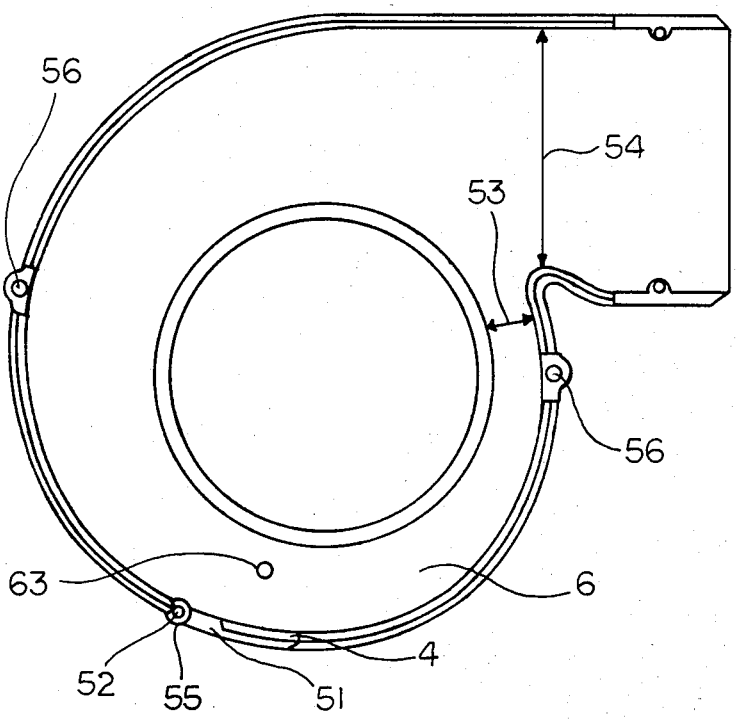
FIGS. 5A and 5B, depict a right side elevational view of the right portion of an inner housing (i.e. showing the back side) and a bottom view thereof in section; wherein the opening in the inner housing is shown.
Figure 6A:
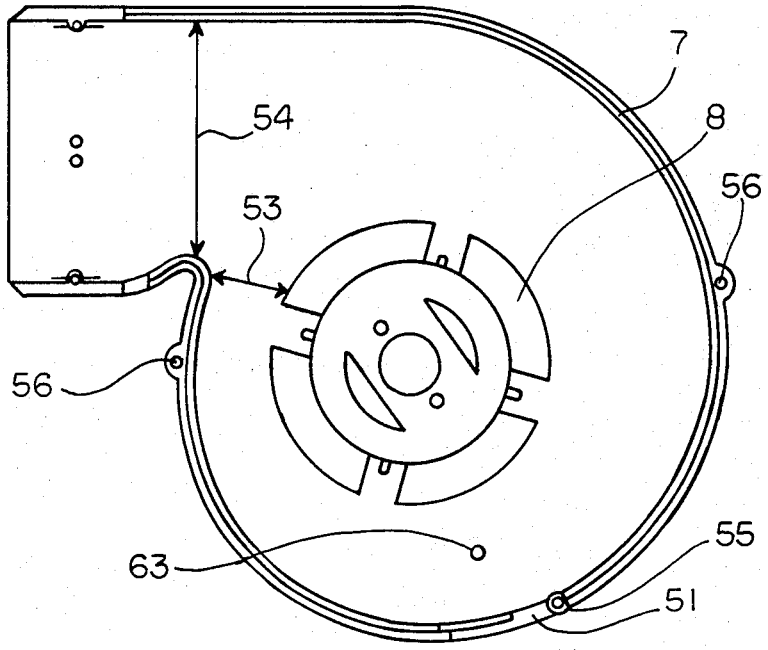
FIGS. 6A and 6B depict a left side elevational view of the left portion of an inner housing (i.e. showing the back side) used in the embodiment of FIG. 1; and a bottom view thereof in section; wherein the opening in the housing is shown.

As shown in FIGS. 5A and 6A, when the left and right portions of the inner housing are attached together, the interior cross section thereof varies from a minimum dimension 53 and gradually increases in dimension until it connects with the nozzle at area 54. Thus, air driven in through the inner housing opening at the sides thereof increases in volume as the air travels counterclockwise toward the nozzle.

It was discovered that the rate of air flow exhausted from the nozzle mouth could be mechanically varied with minimum effect on motor load by providing an opening in the inner housing periphery, with a rotatable door, which would direct some of the air moved about the axis by the fan, out of the inner housing.

The air flow varying device mechanisms, is shown in FIGS. 1 and 2 comprising hole 51 in inner housing parts 6,7; a rotatable door 4 rotatable about axis 52; and lever 5 which is connectable to knob 60 of door 4, to move it from one position to another.

Figure 5B:
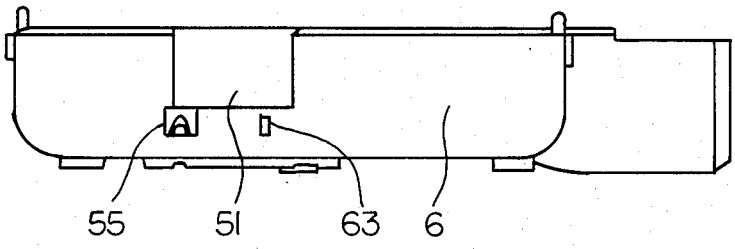

FIGS. 5A and 5B show the back side of the right inner housing 7 and depicts opening 51 located toward the bottom of FIG. 5A with the opening for the nozzle located toward the top and facing away from the opening 51.

Figure 6B:
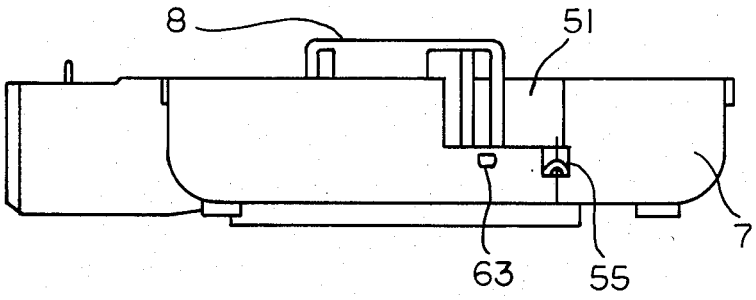

FIGS. 6A and 6B similarly show the back side of the left inner housing 6, and depict opening 51 (air exit hole) located to be opposite the opening 51 in right inner housing 7. Thus, when the two inner housing portions 6 and 7 are attached to each other by screws, for example, fitting into holes 56, the combined opening 51 will be substantially rectangular and shaped to be similar to the periphery of the inner housing. The door 4 will likewise be similarly shaped to enable a tight fit over the hole 51.

An inset 55 (see FIGS. 5A, 5B, 6A, 6B) is provided in both inner housing portions 6 and 7, for rotatably holding door 4 at the axis 52.

Figure 7A:
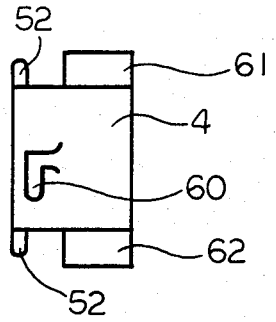
FIGS. 7A and 7B depict an illustrative rotating door used to adjust the degree of opening in the inner housing opening.
Figure 7B:
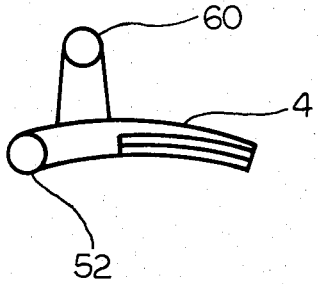

The construction of the door 4 is shown in FIGS. 7A and 7B. Rotatable door 4 has at one end on both the top and bottom, pole extensions 52, which are insertable into inset holes 55, located at one end of opening 51, in the inner housing portions 7 and 6. The door 4, upon insertion of pole extensions 52 into insets 55, is rotatable to open and close the hole 51. The door 4 is positioned to be inside the inner housing and in a closed position will close the opening 51 to the outside; and when the door opens it swings to the inside until the wall extensions 61 and 62 hit against the door stops 63 in inner housing 6 and 7. The door stops are located at a position so that the door will not interfere with the rotation of fan 9. Also attached to door 4 is a knob 60 to which a channel 71 (See FIGS. 2, 8A, 8B) in lever 5 is fitted for movement of door 4.

Figure 4:
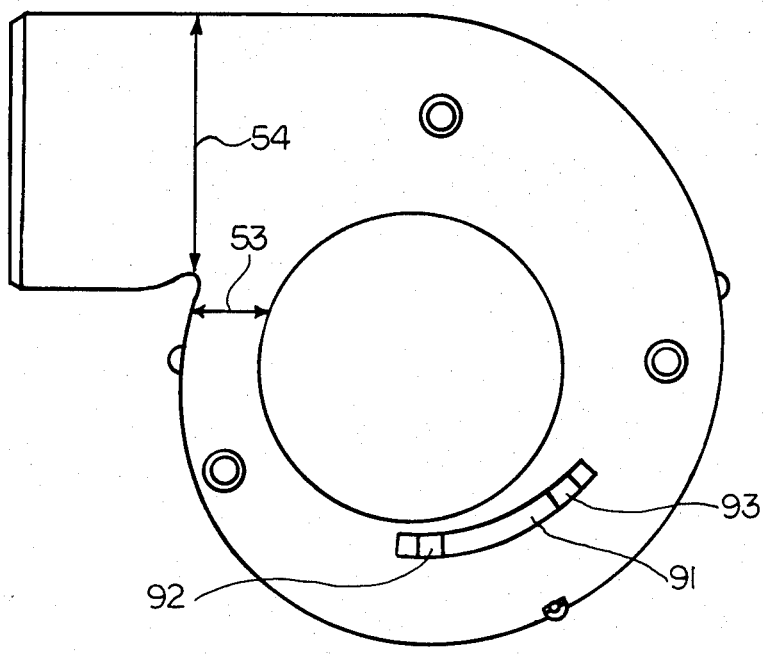
FIG. 4 depicts a left side elevational view of the right portion of an inner housing used in the embodiment of FIG. 1, and showing a lever locking mechanism.
Figure 8B:
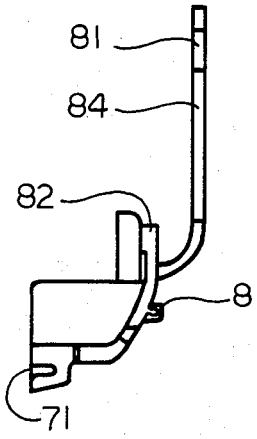
FIGS. 8A and 8B depict a side elevational view and cross section of an illustrative lever used to manipulate the opening and closing of the door of FIGS. 7A and 7B.
Figure 8A:
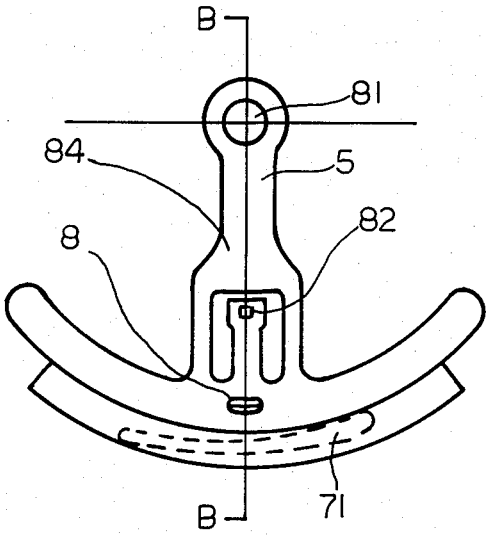

Turning now to FIGS. 8A and 8B, and referring also to FIG. 1 and FIG. 2, lever 5 comprises a handle portion 84, the end of which has a hole 81 for rotatably attaching via an attaching screw to the right outer housing 1; a built up button like protrusion 82, which, when the entire dryer arrangement is assembled, is resiliently held against a locking arrangement 91 (See FIGS. 4 and 1) on inner housing 7 having two or more inset positions. Thus, when lever 5 is moved it will move button 82 to contact locking piece 91 from, e.g. a low position 92 to the left to a high position 93 to the right. The button 82 will thus fit into inset 92 or 93 for the two positions. Lever 5 also has a button 8 (see FIG. 2) which appears through an opening in the outer housing 1 and is movable by the operator, to thereby move the gate 4. Lever 5 also has at the lower part, a channel 71 which engages knob 60 of door 4 (see FIGS. 2 and 7A). Thus, when the operator moves button 8, from left to right, or right to left, the knob 60 of door 4, held in channel 71, will move door 4 about its axis 52, to open and close the opening 51 of inner housing 6, 7, so that air circulated therein by fan 9 will be bled off, in one position, and no air will be bled off in another position. Channel 71 is oriented in such a manner that the circular rotation of lever 5 about its axis 81 will suitably move knob 60 and hence move door 4 about its axis 52.

Figure 3:
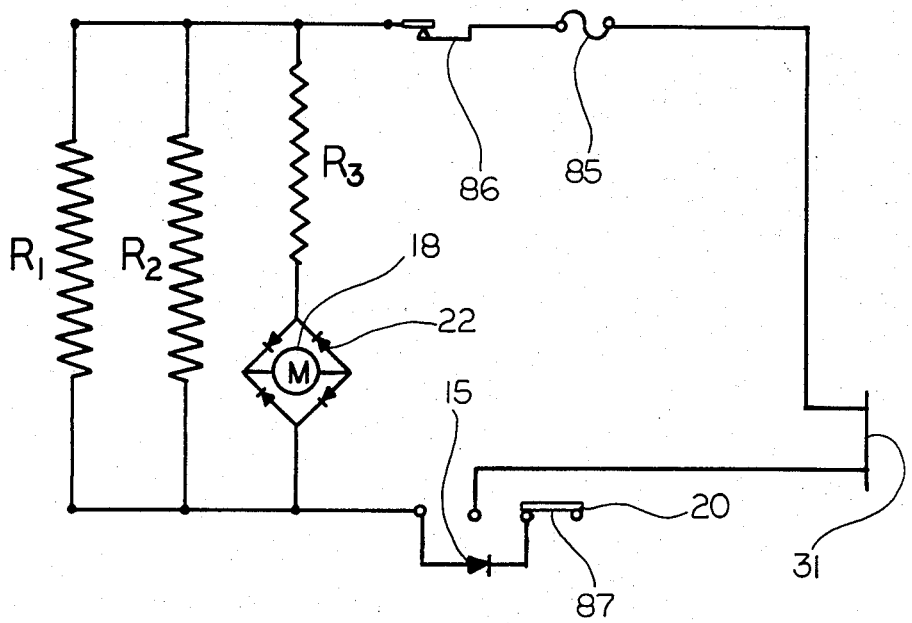
FIG. 3 depicts a schematic diagram of an electrical circuit used in the embodiment of FIG. 1.

Turning now to FIG. 3, the electrical circuit for the hair dryer comprises an input lead 31, such as a plug and wire connectable to an external A-C household supply; a fuse 85; a thermostat 86; heater coils $R_1$, $R_2$ and $R_3$; motor 18 connected to a bridge rectifier 22, diode 15 and 3 position switch 20. The various electrical elements and components are of suitable value to perform their different functions and are readily calculated. For example, the heating coils $R_1$, $R_2$ and $R_3$ in the high position draws 1200 watts and in the low position draws 550 watts.

The electrical switching arrangement, advantageously, may be independent of the mechanical variable air speed mechanism. In one position, such as depicted, the power is off. In the next position, when bar 87 connects the input 31 to the positive electrode of diode 15, only half wave current is applied to the heating coils $R_1$, $R_2$, $R_3$ and motor 18. Thus, lower heat and lower motor speed will result. In the next position, when bar 87 connects line 31 to the parallel connection of coils $R_1$, $R_2$ and $R_3$ and bridge rectifier 22, full wave A-C is applied thereto, and full heat and full motor speed will result. In each of these two electrical positions, the air flow can be varied independently and separately by mechanical opening of door 4 to different positions. Thus, advantageously, air flow velocity may be varied without any substantial effect on the heating temperature and motor speed.

Because the air flow rate is mechanically controlled, separate and independent from the electrical control of the motor speed and heat when the air flow is varied, there is only slight change in the motor speed. It was discovered that this motor change was at most about 5%. The efficiency and life of the dryer were found to have increased dramatically.

The foregoing description is illustrative of the principles of the invention. Numerous variations and modifications thereof would be apparent to the worker skilled in the art. All such variations and modifications are to be considered to be within the spirit and scope of the invention.

What is claimed is:

1. A hot air hand held hair dryer comprising an outer housing; an inner housing within said outer housing; nozzle means connected to said outer housing for exhausting air; motor; fan disposed within said inner housing and driven by said motor; electrical heater means disposed within said nozzle means; whereby said motor drives said fan to circulate air within said inner housing and to contact said electrical heater means for heating the air prior to exhausting through said nozzle; and adjusting means for providing an adjustable opening in said inner housing to provide an outlet from said inner housing to a space between said inner housing and said outer housing for a portion of air flow being circulated from said fan.

2. The dryer of claim 1, wherein said adjusting means comprises an opening in the outer periphery of said inner housing; a movable door for adjusting the amount of said opening; and means for stopping said door at one of a plurality of predetermined positions.

3. The dryer of claim 2, wherein said adjusting means comprises a lever mechanism having a channel means, and means for locking said lever in at least two positions; and wherein said door has a knob for fitting in said channel means of said lever mechanism; and wherein said inner housing has a protrusion with at least two insets for holding said means for locking of said lever.

4. A hot air hand held hair dryer comprising an outer housing having a handle portion, a central portion having an opening to the outside, and connected to said handle portion, and a mouth portion connected to said central portion for exhausting air circulated therewithin;

motor means held in said central portion;

an inner housing means having an opening to said mouth portion, and another opening to said openings in said central portion of said outer housing, said inner housing being disposed within said outer housing;

fan means driven by said motor means and located in said inner housing, for pulling air in from outside of said inner and outer housings through said openings in said central portion and circulating same and exhausting the circulated air through said mouth portion;

electrical heater means located in said mouth portion of said outer housing, for heating said circulated air prior to exhausting of said circulated air out of said mouth portion;

electrical switching means for controlling the amount of current applied to said heater means and for controlling the amount of current applied to said motor means; and adjusting means for adjusting the amount of air flow exhausted from said mouth, independently of said electrical switching means, and with minimum effect on load to said motor; wherein said adjusting means comprises an opening near the outer periphery of said inner housing, and at a location away from said mouth portion, door means disposed to cover said opening in one position, and to allow an opening therein in another position.

5. The dryer of claim 4, wherein said adjusting means comprises a pivot means for rotating the door thereabout, said pivot means comprising an inset in said inner housing near the edge of said opening, and pole extensions in said door toward the end thereof; and said door means further comprising a knob and wall extensions; and wherein said inner housing has one or more knobs disposed to restrict movement of said door by stopping movement of said wall extensions; and wherein said adjusting means further comprises a lever means having channel means for engaging said knob on said door means for moving said door means about said pole extensions.

6. The dryer of claim 4, wherein said switch means comprises a three position switch with a diode connected to one position whereby movement of said switch to said one position causes only half wave current to be applied to said motor and to said heater, and connecting of said switch to another position applies full wave current to said heater and to said motor.

* * * * *